United States Patent [19]

Schumann

[11] Patent Number: 4,858,539

[45] Date of Patent: Aug. 22, 1989

[54] ROTATIONAL SWITCHING APPARATUS WITH SEPARATELY DRIVEN STITCHING HEAD

[75] Inventor: Frank Schumann, Machern, German Democratic Rep.

[73] Assignee: VEB Kombinat Polygraph "Werner Lamberz" Leipzig, Leipzig, Fed. Rep. of Germany

[21] Appl. No.: 162,433

[22] Filed: Mar. 1, 1988

[30] Foreign Application Priority Data

May 4, 1987 [DD] German Democratic Rep. ... 302355

[51] Int. Cl.[4] ..... D05B 3/00; D05B 69/02; B42B 1/02

[52] U.S. Cl. ..... 112/21; 112/121.14; 112/121.15; 112/220; 112/303

[58] Field of Search ..... 112/21, 22, 121.4, 121.15, 112/220, 303

[56] References Cited

U.S. PATENT DOCUMENTS

| | | | |
|---|---|---|---|
| 2,966,810 | 1/1961 | Hayes | 112/220 X |
| 3,763,798 | 10/1973 | Böttscher | 112/21 |
| 3,763,799 | 10/1973 | Böttcher | 112/21 |
| 4,041,883 | 8/1977 | Meratti | 112/21 |
| 4,704,973 | 11/1987 | Horst | 112/21 |

FOREIGN PATENT DOCUMENTS

| | | | |
|---|---|---|---|
| 75297 | 8/1970 | German Democratic Rep. . | |
| 241045 | 11/1986 | German Democratic Rep. . | |
| 399417 | 3/1966 | Switzerland | 112/21 |

*Primary Examiner*—H. Hampton Hunter
*Attorney, Agent, or Firm*—Jordan and Hamburg

[57] ABSTRACT

A rotational stitching apparatus with separately driven stitching head is used for stitching folded sheets by wire and thread clamping, thread sealing, and loop thread stitching. The drive system permits autarkic stitching heads to be optionally replaced and to be adjusted in correspondence with the product assortment. Each stitching head has a stitching head driveshaft, by means of which it is connected to the stitching cylinder driveshaft 1 or the cylinder axle 37, preferably by way of a gear or the toothed belt. Implementation of various stitching technologies is made possible by additional apparatus disposed peripherally to the stitching cylinder circumference.

4 Claims, 6 Drawing Sheets

ROTATIONAL SWITCHING APPARATUS WITH SEPARATELY DRIVEN STITCHING HEAD

The invention is directed to a rotational stitching apparatus with separately driven stitching heads for stitching single sheets in conjunction with web-fed rotary printing machines or folding machines, to fabricate single-layer brochures and multi-layer products.

BACKGROUND OF THE INVENTION

DD 241.045 proposes a method and a device for single sheets and thread book stitching in which the stitching thread is pushed through the sheet by means of the feed needles of the stitching head, whereby the thread filaments are tensioned. The return needles, which are disposed pairwise between the feed needles, grip the thread that is thus tensioned and conduct it back through the puncture opening to conclude the stitching process at the single sheet. The tensioned thread ends can now be joined to the stitched material by means of knots or, if clamps have previously been formed, by welding or gluing. The stitching head is driven by a central shaft and represents a combination of cams and link transmissions. Disadvantages of this solution are primarily as a result of its limited productivity, due to the stationary stitching material.

DD-PS 75.297 proposes a method and a device for thread stitching folded sheets in which the stitching material is arrested on a cylinder by means of a clamping device, and cut textile, thermoplastic or impregnated thread is pushed through the sheet by the stitching needles. While the resulting thread ends or loops run around the cylinder, they pass devices by means of which they are sealed or glued. The device is driven by a control cam fixedly disposed at the center of the rotating cylinder. The control cam controls the radial motion of the stitching needles which are connected to it by cam rollers. This contact is maintained by means of pressure springs. A disadvantage of this solution is primarily the occurrence of centrifugal force and the proneness to vibrations at the elements of the production means that are released by the cam disk drive, further the fact that the stitching elements cannot be replaced quickly, and the fact that the binding methods are restricted to French sewing and sealing, due to the limited number of usable different laws of motion.

SUMMARY OF THE INVENTION

It is the object of the invention to increase productivity for single-sheet stitching, so that use in conjunction with modern folding machines is ensured and web-fed rotary printing machines.

For this purpose a device is provided by means of which the moved stitching material can be processed by the stitching heads, whose driving principle permits a high operating speed, and also permits the stitching heads to be replaced and adjusted quickly.

According to the invention, sheet gripping elements and stitching heads for stitching single sheets are disposed, in well-known fashion, along the circumference of a stitching cylinder. Along the circumference of the cylinder, the stitching cylinder has devices associated with it, which are needed for fabrication, depending on the type of stitching technology. While the needle is puncturing the paper, it is always necessary for a counter bearing to act at the cylinder circumference.

During the sealing of the cylinder thread, the thread infeed and thread cutting device and the sealing bar are positioned one after another. During stringing and looping, the thread infeed and thread cutting device are attached to the stitching cylinder; during wire stitching, the cutting device and the thread stitching device are attached to the stitching cylinder. Every one of the stitching heads has a driveshaft, by means of which it is connected to the main drive. The needles and the gripping elements are driven in the stitching head itself, preferably by disk cams. The stitching heads are connected to the main drive, with the single-cylinder mode of construction, preferably by several stitching cylinder gears, which engage a central wheel that runs around a bearing on the cylinder driveshaft. The rotation is tapped from the cylinder driveshaft and is transferred through a transmission to the driveshafts of the stitching heads. As a result, the rotational speed of the stitching head driveshafts corresponds to the rotational speed of the cylinder driveshaft or to an integral multiple thereof, so that during one rotation of the cylinder driveshaft, the functions of the stitching head execute adequately in conjunction with this.

In a modified design—a double-cylinder mode of construction—two cylinders together with their receiving devices for the sheet grippers are rotatably mounted on an axle. Axially movable stitching heads may be disposed between the cylinders near the circumference of the cylinder. One or more stitching head driveshafts or intermediates shafts to drive them are connected, by way of two belts, to a toothed disk that is fixedly disposed on the cylinder axle. When the cylinder rotates, different sections of the toothed belt always engage the toothed disk of the cylinder shaft. This also makes it possible for one stitching head driveshaft rotation to be associated with one cylinder rotation. For example, it is possible to move the stitching head laterally by means of intermediate shafts, in order to change the position of the stitching line with respect to the sheet conveyance line.

Thus it is possible to operate the stitching heads of the various binding methods by means of the same drive principle. Inasmuch as the autarkic drive principles of the individual stitching head versions do not mark out performance limits, the drive system described above can be guaranteed to adapt cylinder stitching to the productivity of more modern web-fed rotary printing and folding machines. Beyond this, the drive principle permits further adaptation to changing product assortment.

By using the fold-flap cylinder for stitching, or by using any other cylinder that is in any case present in the web-fed rotary printing machine, a considerable amount of complexity is saved. This primarily concerns the sheet infeed and the feeding of the fold. Furthermore, because the input and output cylinders are missing, and because thus there are fewer sheet transfers, the stitching precision or the spacing between the fold and stitching line is reduced. For example, if the fold-flap cylinder is used as the stitching cylinder, only this one must be designed so as to be adjustable axially and at the circumference. The above-mentioned means are to be used for this in principle. The processing material continues to be guided by means of the fold flaps.

BRIEF DESCRIPTION OF THE DRAWINGS

The invention will now be explained in more detail by means of the following embodiments.

DETAILED DISCLOSURE OF THE INVENTION

Figure 1:
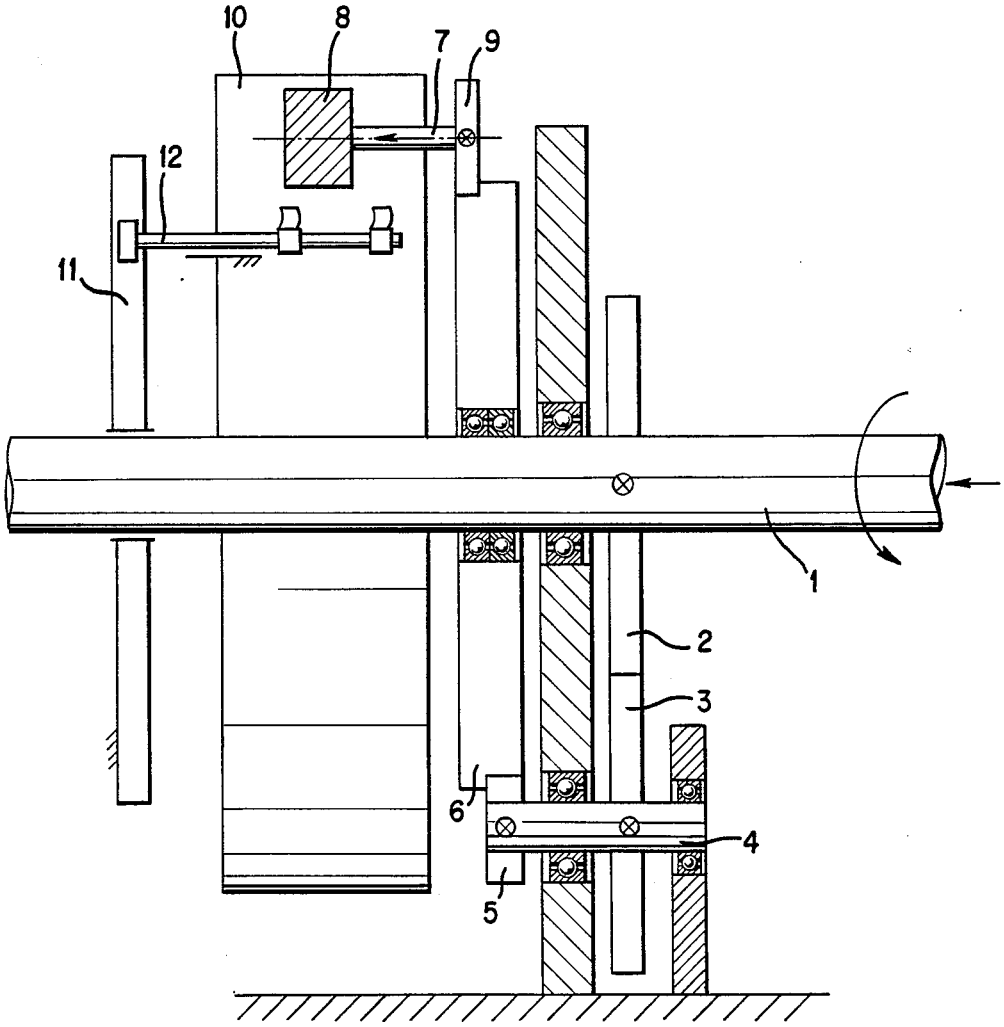
FIG. 1 shows a stitching cylinder with a driveshaft, a transmission gear, a stitching head, and a sheet gripper.
Figure 2:
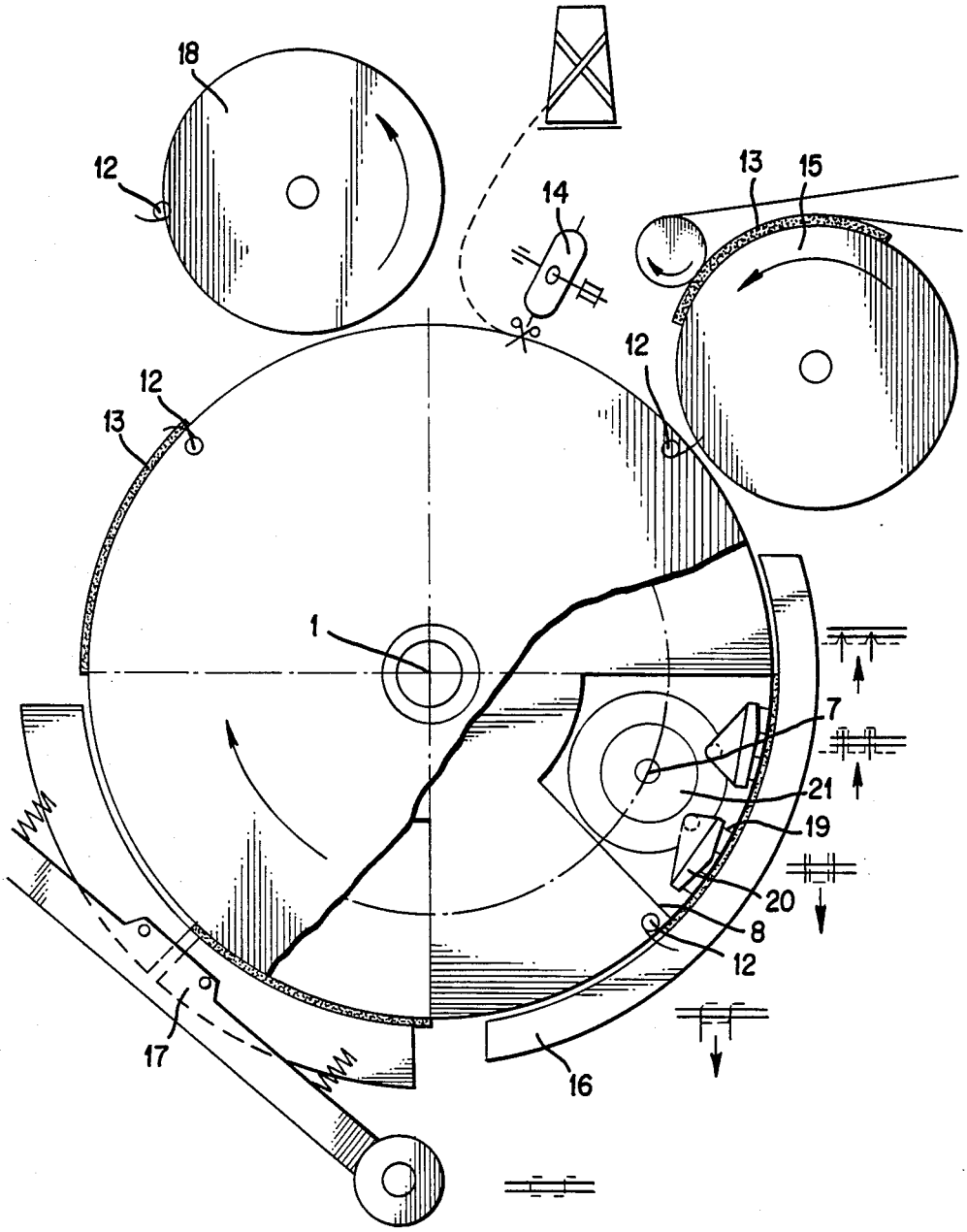
FIG. 2 shows a stitching cylinder with a stitching head, equipment for sealing the thread, and the displayed phases of thread sealing.

As shown in FIG. 1, a gear 2 is disposed on the cylinder driveshaft 1. The gear 2 engages the gear 3 on the shaft 4. The gear 5, which rotates with the shaft 4, engages the sun gear 6, which forms the last gear of the rotational transmission. The sun gear 6 drives the gears 9, which are disposed on the stitching head driveshafts 7 of the stitching heads 8, and which rotate as planetary gears. Thus, when the cylinder driveshaft 1, which is connected to the stitching cylinder 10, makes one revolution, the stitching head driveshafts 7 simultaneously make one revolution or an integral multiple thereof. The control cam 11 is used to drive the sheet gripping elements 12, by means of which the sheet 13 is seized, stopped, and is then released after stitching (FIG. 2). Depending on the operational sequence, the fabrication elements required for thread sealing are disposed along the stitching cylinder circumference. Beginning with the thread intake and cutting device 14, there follow in succession the sheet infeed device 15, the counter bearing 16, the sealing rail 17, and the sheet take-off device 18.

Figure 3:
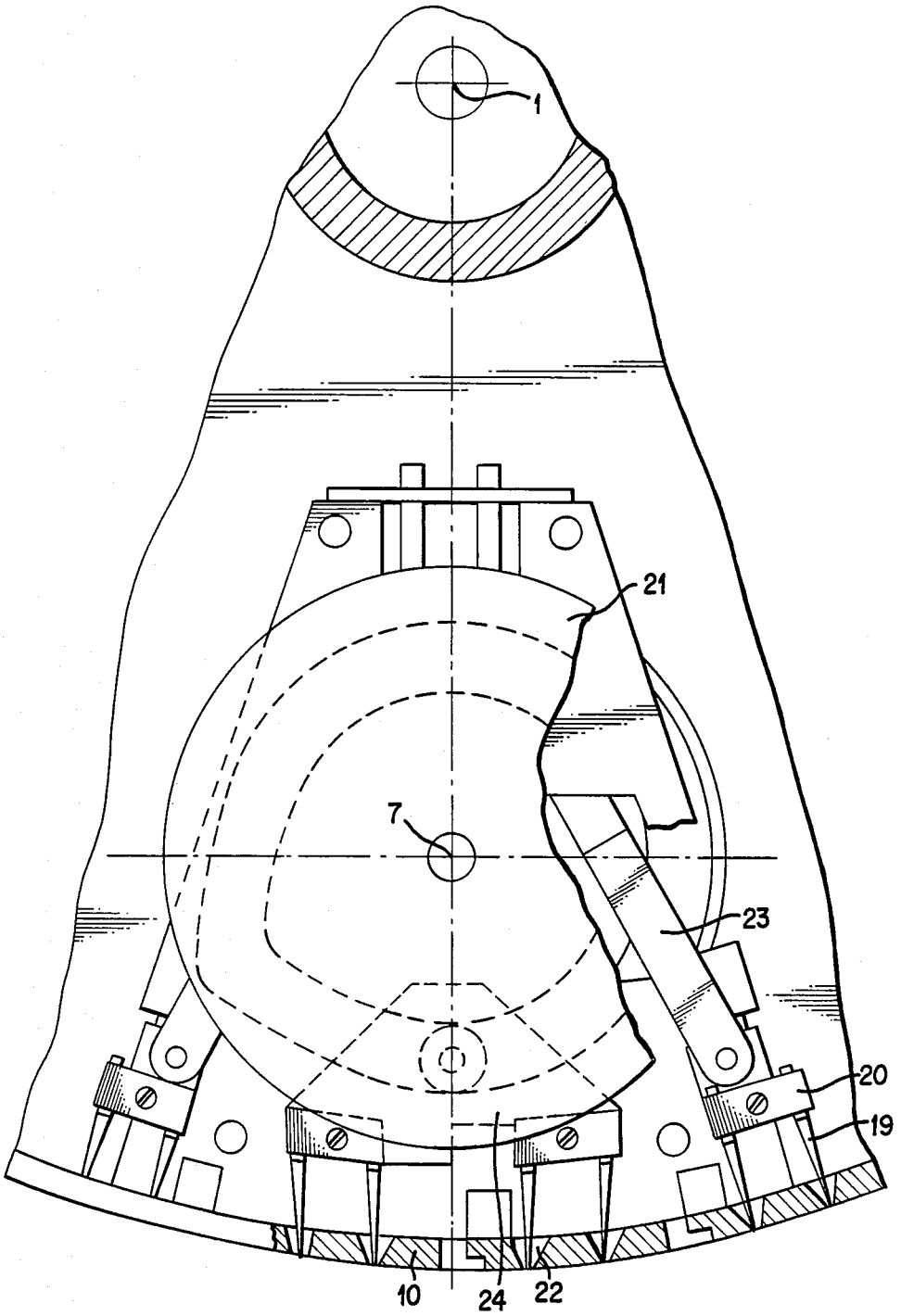
FIG. 3 shows the stitching head for thread sealing with fabrication and drive elements.

FIG. 2 furthermore shows the stitching head 8 with its punching needle 19, the needle support 20, and the control cam 21. The phases of the formation of the thread clamp are also marked in the processing direction. FIG. 3 shows a modified stitching head 8 for thread sealing, in its operating position. The punching needles 19 and their exit openings 22 in the stitching cylinder 10 are shown. The needle supports 20 are connected to the control cam 21 via the push rod 23 or via the support element 24. The control cam 21 is fasted on the stitching head driveshaft 7.

Figure 5:
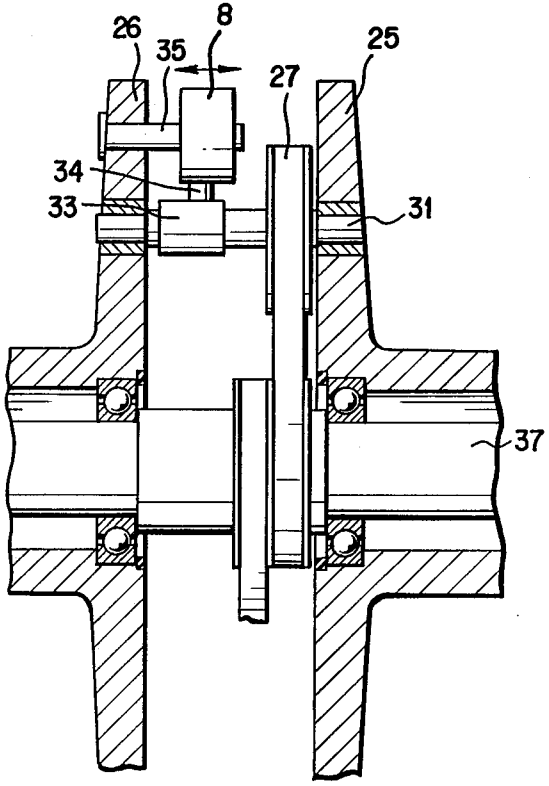
FIG. 5 shows a two-cylinder design with a toothed belt drive in a sectional representation, with auxiliary shafts whose purpose is to adjust the stitching head axially.
Figure 4:
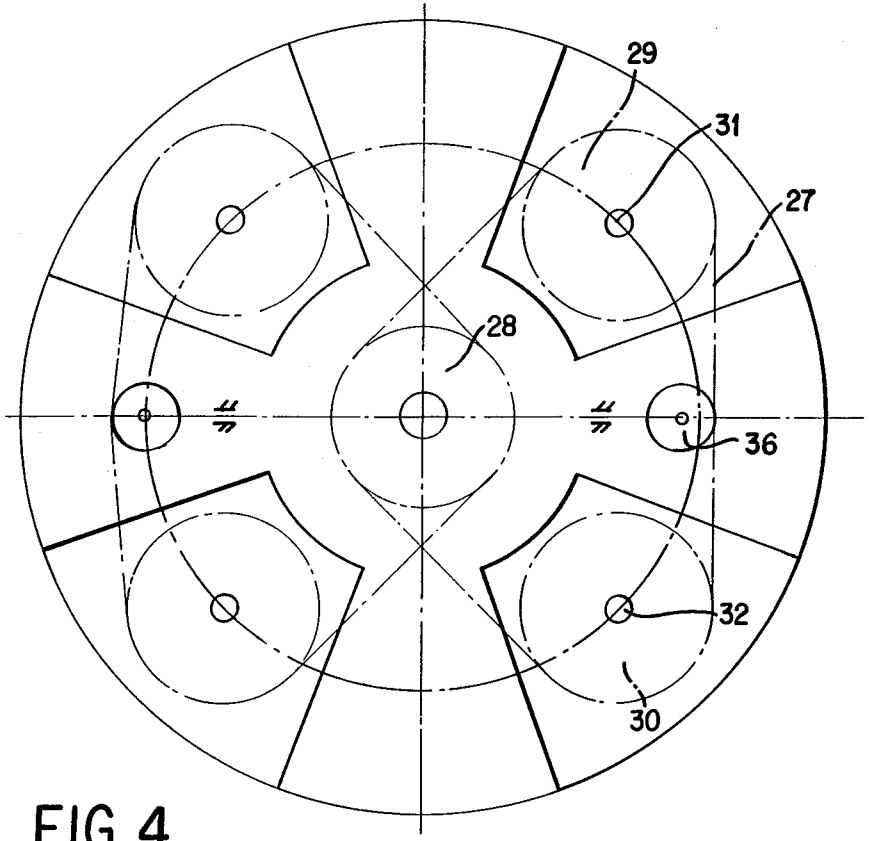
FIG. 4 shows a two-cylinder design with a toothed belt drive.

FIGS. 4 and 5 show a split cylinder design of the stitching cylinder including the drive of the stitching heads 8, which are mounted between the right cylinder half 25 and the left cylinder half 26. The toothed belt 27 for this purpose connects the toothed belt disk 28 on the cylinder axle 37 to the toothed belt disks 29, 30 of each pair of intermediate shafts 31, 32, where the gear wheel 33 engages the side gear 34 of the stitching head 8. The stitching head 8 on this part is movably fastened on the stitching head fastening pin 35, which makes the stitching heads 8 adjustable. To guarantee a constrained transfer, the drive is equipped with belt tensioning elements 36.

Figure 7:
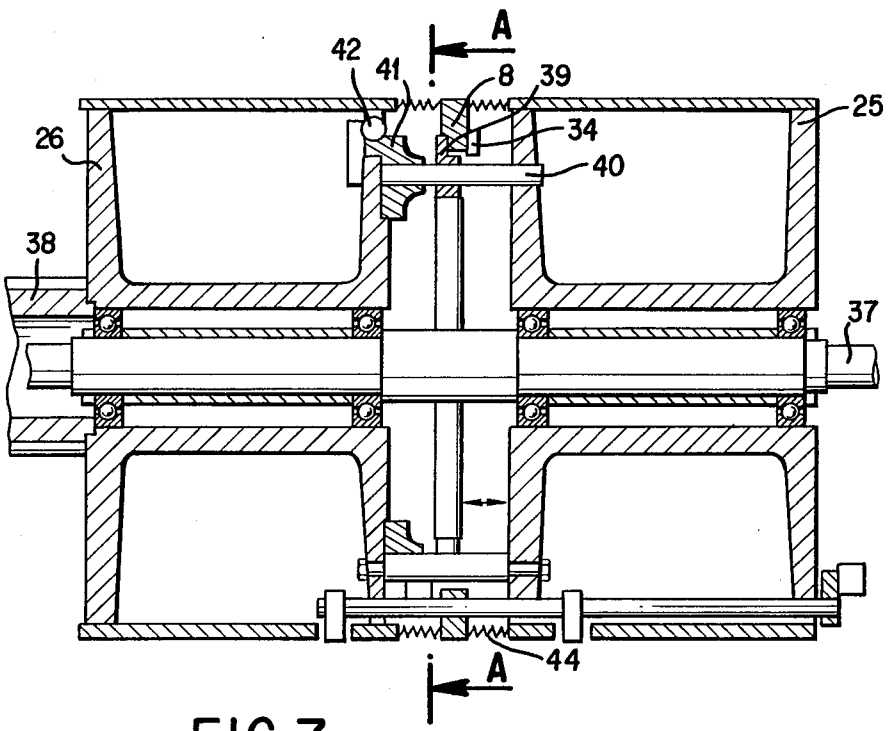
FIG. 7 shows a two-cylinder design with a drive gear in section B-B.
Figure 6:
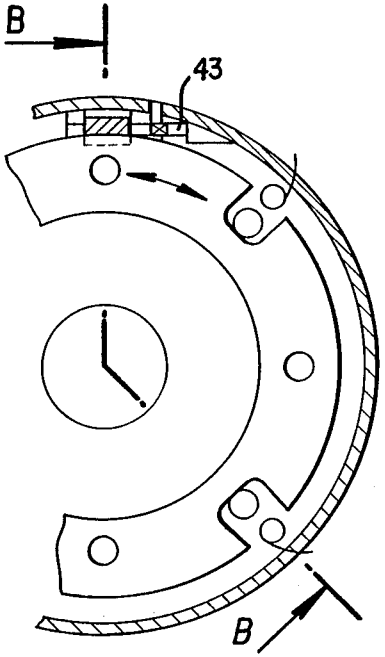
FIG. 6 shows a two-cylinder design with a stitching head adjusting device in section A-A.

FIGS. 6 and 7 show the two-cylinder design with devices to adjust the stitching head 8. The section along the cylinder axle 37 shows, starting from a driving gear wheel 38, the stitching head 8 positioned on the stitching head support 39, which on its part has movably mounted support pins 40 which are reinforced by pin supports. The pin support 41 is paired with a fixed worm gear 42. When the worm gear 42 is turned, the stitching head support 39 can also be pivoted about the cylinder axle 37 relative to the sheet guiding elements. For this purpose, the worm gear 42 is fixed in a guide 43. In the area of axial displacement, the stitching cylinder 10 has a covering 44.

Figure 8:
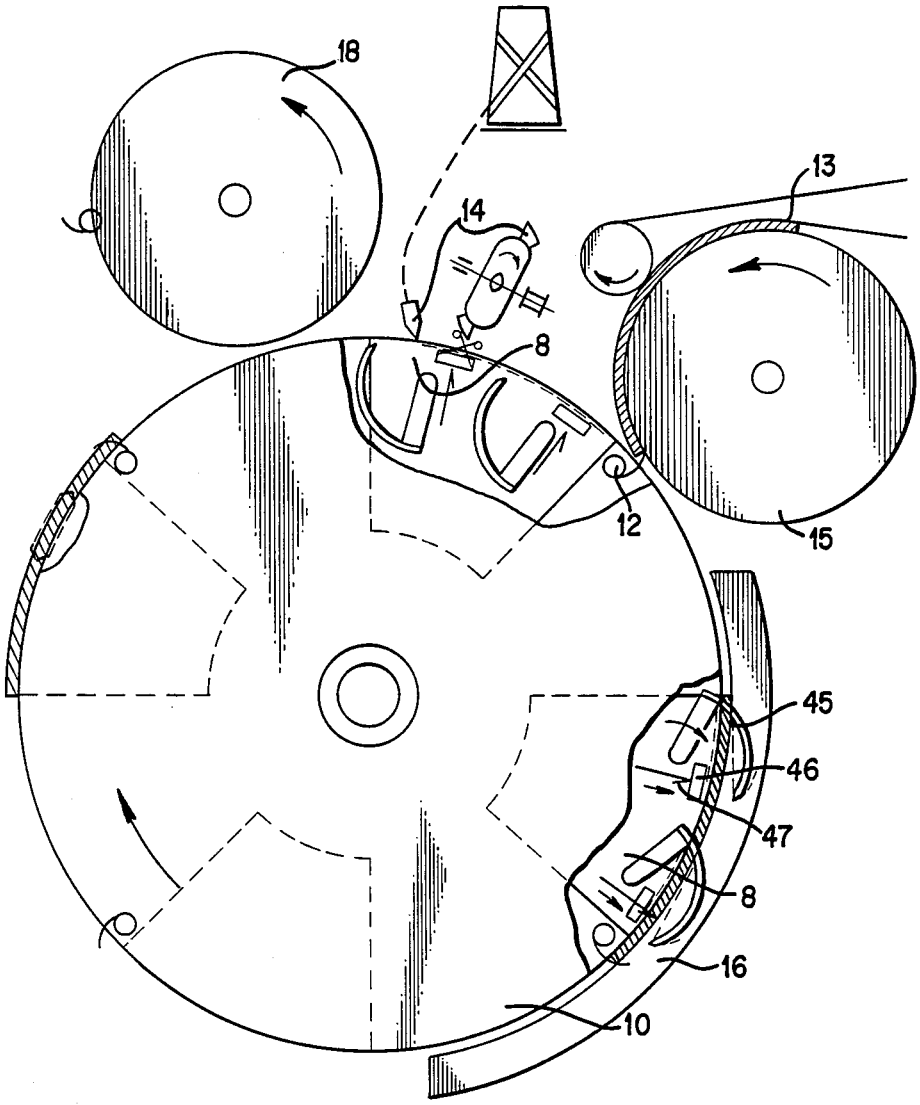
FIG. 8 shows a stitching cylinder with stitching heads and with devices for loop thread stitching.

The loop thread stitching shown in FIG. 8 is implemented by the thread infeed and cutting device 14, as well as by the sheet infeed device 15 and the sheet take-off device 18. Furthermore, the counter bearing 16 is attached to the stitching cylinder 10 in the area of the loop stitching process. The curved needle 45, the looper 46, and the hook needle act as fabrication elements integrated into the stitching heads 8.

I claim:

1. Apparatus for stitching together a plurality of paper sheets comprising a rotationally driven cylinder for transporting on a cylindrical surface of the cylinder the sheets as well as thread for stitching together the sheets, a plurality of stitching heads spaced from each other about the circumference of the cylindrical surface, each of the stitching heads being recessed within the cylindrical surface and including a plurality of needles having free pointed ends, each of the stitching heads also including means for supporting the needles, the needle supporting means being movable with respect to the cylinder to drive the pointed needle ends into, through and back out of said sheets on the cylindrical surfaces of the cylinder thereby to stitch said sheets together by means of said thread, each of the stitching heads also including a cam shaft and a cam fixed on the cam shaft and connected to the needle supporting means for effecting said movement of said needle supporting means, a drive shaft for the cylinder, the cylinder being fixed on the drive shaft coaxially therewith, a sun gear rotationally mounted on the drive shaft, a respective planetary gear fixed on each of the cam shafts, the sun gear being in engagement with the planetary gears for driving the cam shafts, and a gear train connecting the drive shaft directly to the planetary gear for driving of the planetary gear by the drive shaft, gear ratios of the gears being predetermined so that each of the cam shafts makes an integral number of revolutions of at least one for each revolution of the drive shaft.

2. Apparatus according to claim 1, in which the gear train comprises a gear fixed on the drive shaft, a transmission shaft rotationally mounted parallel to the drive shaft, first and second transmission gears fixed on the transmission shaft, the first transmission gear being in engagement with the gear fixed on the drive shaft for driving of the transmission shaft by the drive shaft and the second transmission gear being in engagement with the planetary gear for driving of the planetary gear by the transmission shaft.

3. Apparatus according to claim 2, further comprising mounted on the cylinder adjacent each stitching head respective grippers for gripping the sheets while the stitching head is stitching the sheets, and a control cam fixed on the drive shaft, the control cam being operatively connected to the grippers for actuating the grippers.

4. Apparatus for stitching together a plurality of paper sheets comprising a rotationally driven cylinder for transporting on a cylindrical surface of the cylinder the sheets as well as thread for stitching together the sheets, the cylinder being split in a radial plane into two cylinder halves, a plurality of stitching stations spaced from each other about the circumference of the cylindrical surface, an axle for the cylinder, the cylinder being rotatably mounted on the axle, each of the stitching stations including a shaft axially parallel to the axle and interconnecting and rotatably supported by the cylinder halves, a respective gear fixed on each said shaft, a respective pulley fixed on each said shaft, a pulley fixed on the axle and located between the cylinder halves, a belt drivingly engaging the pulley on the shaft and the pulley on the axle, each of said stitching stations including a pin axially parallel to the axle and the shaft and fixed to one of said cylinder halves and extending into a space between the cylinder halves, each of said stitching stations including a respective stitching head slidably mounted on each said pin, and the stitching head including a gear in engagement with the gear on the shaft, the gear on the shaft being of greater axial dimension than the gear of the stitching head so that the position of the stitching head may be adjusted by sliding the stitching head on the pin while the gear of the stitching head remains in engagement with the gear on the shaft.

* * * * *